US008491283B2

(12) United States Patent
Miyazaki et al.

(10) Patent No.: US 8,491,283 B2
(45) **Date of Patent: *Jul. 23, 2013**

(54) MICROPUMP

(75) Inventors: Hajime Miyazaki, Matsumoto (JP); Kazuo Kawasumi, Chino (JP)

(73) Assignee: Seiko Epson Corporation (JP)

( * ) Notice: Subject to any disclaimer, the term of this patent is extended or adjusted under 35 U.S.C. 154(b) by 332 days.

This patent is subject to a terminal disclaimer.

(21) Appl. No.: 12/508,886

(22) Filed: Jul. 24, 2009

(65) Prior Publication Data

US 2010/0047099 A1 Feb. 25, 2010

(30) Foreign Application Priority Data

Aug. 20, 2008 (JP) ..... 2008-211483

(51) Int. Cl.
*F04B 43/08* (2006.01)
*F04B 43/12* (2006.01)
*F04B 45/06* (2006.01)

(52) U.S. Cl.
USPC ..... 417/474

(58) Field of Classification Search
USPC ..... 417/478, 479, 474–477.14, 477.3
See application file for complete search history.

(56) References Cited

U.S. PATENT DOCUMENTS 3,574,883 A * 4/1971 Brittain et al. ..... 15/250.02
3,630,647 A * 12/1971 Kochlin ..... 417/474
4,155,362 A * 5/1979 Jess ..... 604/507
4,187,057 A 2/1980 Xanthopoulos
4,607,764 A * 8/1986 Christine ..... 222/207
4,648,812 A * 3/1987 Kobayashi et al. ..... 417/474
4,735,558 A * 4/1988 Kienholz et al. ..... 417/477.2
4,869,646 A * 9/1989 Gordon et al. ..... 417/18
4,909,710 A * 3/1990 Kaplan et al. ..... 417/53
4,954,046 A * 9/1990 Irvin et al. ..... 417/53
5,049,047 A * 9/1991 Polaschegg et al. ..... 417/474
5,083,908 A 1/1992 Gagnebin et al.
5,249,937 A 10/1993 Aubert (Continued)

FOREIGN PATENT DOCUMENTS

EP 0 570 134 11/1993
JP 54-103290 8/1979

(Continued)

OTHER PUBLICATIONS

Extended European Search Report for application No. 09171345.3 (6 pages), dated Nov. 19, 2010.

*Primary Examiner* — Devon Kramer
*Assistant Examiner* — Christopher Maxey
(74) *Attorney, Agent, or Firm* — Harness, Dickey & Pierce, P.L.C.

(57) ABSTRACT

A micropump including a tube unit and a control unit. The control unit has a plurality of fingers. A cam sequentially presses the plurality of fingers from an inlet side to an outlet side of the tube. A drive unit gives rotation force to the cam, a control circuit unit controls operation of the drive unit, and a device frame holds the plurality of fingers, the cam, the drive unit, and the control circuit unit. A reservoir communicates with an inlet port of the tube; and a power source supplies power to the control circuit unit, wherein the tube unit is detachably attached to the control unit substantially in the horizontal direction with respect to the rotation surface of the cam and attached to the inside of a space produced by the device frame.

20 Claims, 11 Drawing Sheets

U.S. PATENT DOCUMENTS 5,318,413 A * 6/1994 Bertoncini ..... 417/475
5,342,180 A * 8/1994 Daoud ..... 417/412
5,531,697 A 7/1996 Olsen et al.
5,531,698 A 7/1996 Olsen
5,575,631 A * 11/1996 Jester ..... 417/474
5,647,854 A 7/1997 Olsen et al.
5,658,252 A 8/1997 Johnson
5,683,233 A * 11/1997 Moubayed et al. ..... 417/474
5,791,881 A * 8/1998 Moubayed et al. ..... 417/63
5,817,116 A 10/1998 Takahashi et al.
5,924,852 A * 7/1999 Moubayed et al. ..... 417/474
6,030,190 A * 2/2000 Kammerer ..... 417/477.1
6,106,249 A * 8/2000 Barak ..... 417/474
6,123,686 A 9/2000 Olsen et al.
6,164,921 A * 12/2000 Moubayed et al. ..... 417/44.1
6,253,968 B1 * 7/2001 Van Dijk et al. ..... 222/241
6,371,732 B1 * 4/2002 Moubayed et al. ..... 417/44.1
6,558,347 B1 * 5/2003 Jhuboo et al. ..... 604/67
6,749,587 B2 6/2004 Flaherty
6,872,058 B2 * 3/2005 Doig ..... 417/477.12
6,918,748 B2 7/2005 Miyazawa
7,036,751 B1 * 5/2006 Lund et al. ..... 239/302
7,059,840 B2 * 6/2006 Corwin et al. ..... 417/477.3
7,078,847 B2 7/2006 Miyazawa et al.
7,116,037 B2 10/2006 Moteki et al.
7,238,010 B2 * 7/2007 Hershberger et al. ..... 417/477.2
7,556,481 B2 * 7/2009 Moubayed ..... 417/477.3
7,632,079 B2 * 12/2009 Hershberger et al. ..... 417/477.2
7,762,795 B2 * 7/2010 Moubayed ..... 417/477.3
7,963,690 B2 * 6/2011 Thompson et al. ..... 366/275
8,152,498 B2 * 4/2012 Bunoz ..... 417/477.3
2004/0116862 A1 6/2004 Ray
2004/0199118 A1 10/2004 Christenson et al.
2004/0234401 A1 * 11/2004 Banister ..... 417/474
2006/0029505 A1 * 2/2006 Gibson et al. ..... 417/474
2006/0073048 A1 4/2006 Malackowski
2006/0253086 A1 * 11/2006 Moberg et al. ..... 604/272
2007/0154336 A1 * 7/2007 Miyazaki et al. ..... 417/474
2007/0217932 A1 * 9/2007 Voyeux et al. ..... 417/477.2
2007/0231205 A1 10/2007 Williams et al.
2008/0051709 A1 * 2/2008 Mounce et al. ..... 604/131
2008/0065016 A1 * 3/2008 Peterson et al. ..... 604/151
2008/0101967 A1 * 5/2008 Moubayed ..... 417/474
2008/0101968 A1 * 5/2008 Moubayed ..... 417/474
2008/0138218 A1 * 6/2008 Miyazaki et al. ..... 417/410.3
2008/0138222 A1 * 6/2008 Miyazaki et al. ..... 417/474
2008/0304982 A1 * 12/2008 Miyazaki et al. ..... 417/412
2009/0060755 A1 * 3/2009 Miyazaki ..... 417/212
2009/0196766 A1 8/2009 Detering
2009/0196776 A1 * 8/2009 Moubayed ..... 417/477.2
2009/0208350 A1 * 8/2009 Miyazaki et al. ..... 417/316
2009/0240201 A1 * 9/2009 Rotem et al. ..... 604/151
2009/0240210 A1 9/2009 Walton et al.
2009/0312708 A1 * 12/2009 Miyazaki et al. ..... 604/151
2010/0021315 A1 * 1/2010 Wolff ..... 417/53
2010/0047099 A1 2/2010 Miyazaki et al.
2010/0074781 A1 * 3/2010 Miyazaki et al. ..... 417/474
2010/0080720 A1 * 4/2010 Miyazaki et al. ..... 417/477.6
2010/0121306 A1 * 5/2010 Yodfat et al. ..... 604/500
2010/0143168 A1 * 6/2010 Miyazaki et al. ..... 417/412
2010/0296955 A1 * 11/2010 Wolff ..... 417/477.3
2011/0002801 A1 * 1/2011 Miyazaki et al. ..... 417/477.3
2011/0186143 A1 * 8/2011 Miyazaki et al. ..... 137/67
2011/0186598 A1 * 8/2011 Thompson et al. ..... 222/145.6
2011/0186599 A1 * 8/2011 Thompson et al. ..... 222/145.6
2011/0305588 A1 * 12/2011 Miyazaki et al. ..... 417/474
2012/0027624 A1 * 2/2012 Miyazaki et al. ..... 417/53

FOREIGN PATENT DOCUMENTS

JP 62-258178 11/1987
JP 63-83477 6/1988
JP 02-280763 11/1990
JP 05-168709 7/1993
JP 05-314607 11/1993
JP 6-21488 6/1994
JP 07-059853 3/1995
JP 09-262283 10/1997
JP 09-291885 11/1997
JP 10-028731 2/1998
JP 10-193651 7/1998
JP 3177742 4/2001
JP 2001-515557 9/2001
JP 2004-532670 10/2004
JP 2005-046632 2/2005
JP 2005-168958 6/2005
JP 2005-337212 12/2005
JP 2005-351131 12/2005
JP 2006-034845 2/2006
JP 2006-242116 9/2006
JP 2006-314346 11/2006
JP 2007-275548 10/2007
JP 2008-136525 6/2008
JP 2008-161669 7/2008
JP 2008-202602 9/2008
JP 2008-202603 9/2008
WO WO 97/34084 9/1997

* cited by examiner

MICROPUMP

BACKGROUND

1. Technical Field

The present invention relates to a micropump having a tube unit and a control unit attachable to and detachable from each other.

2. Related Art

A wriggling pump is known as a device for transporting liquid at low speed. Recently, such a wriggling pump which rotates a rotor having a plurality of rollers by a step motor as a driving source has been proposed. According to this pump, the rotor rotates along a flexible tube while revolving the plural rollers to suck and deliver liquid (for example, see Japanese Patent No. 3177742).

This type of pump includes a pump module having a tube and a rotor for closing the tube with pressure, and a motor module having a step motor and an output gear mechanism stacked on each other. The pump further includes a gear as a connection element disposed on a rotation shaft of the rotor, and a pinion as a power extracting mechanism disposed on the output gear mechanism. When the pump module and the motor module are stacked for connection, the pinion and the gear engage with each other (tooth engagement) such that rotational driving force of the step motor can be transmitted to the rotor.

According to the structure shown in Japanese Patent No. 3177742, the motor module containing the step motor as the driving source, the output gear mechanism, and the control circuit, and the pump module containing the rotor which includes the tube and the rollers and the connection element are stacked on each other. Thus, the thickness of the structure is difficult to be reduced.

Moreover, a part of the tube is closed with pressure by the rollers for the period from manufacture (assembly) of the pump module to start of use. Thus, restoration ability of the tube lowers, and delivery accuracy decreases.

Furthermore, in the structure which stacks the pump module and the motor module on each other for connection to transmit the rotational driving force of the step motor to the rotor by tooth engagement between the pinion and the gear as the connection elements, the connecting and coupling structure becomes complicated, and assembly becomes difficult.

SUMMARY

It is an advantage of some aspects of the invention to provide a micropump capable of solving at least a part of the problems described above, and the invention can be embodied as the following aspect or embodiments.

A micropump according to a first aspect of the invention includes: a tube unit which includes a tube having elasticity and a circular-arc-shaped part and a tube guide frame for holding the tube; a control unit which has a plurality of fingers extending from the center of the circular-arc shape of the tube in the radial directions, a cam for sequentially pressing the plural fingers from the inlet side to the outlet side of the tube, a drive unit for giving rotation force to the cam, a control circuit unit for controlling operation of the drive unit, a device frame for holding the plural fingers, the cam, the drive unit, and the control circuit unit; a reservoir communicating with an inlet port of the tube; and a power source for supplying power to the control circuit unit. The tube unit is detachably attached to the control unit substantially in the horizontal direction with respect to the rotation surface of the cam.

According to the micropump having this structure, the tube unit is attached to the control unit in the direction substantially horizontal to the rotation surface of the cam. Thus, the thickness of the micropump can be made smaller than that of a related-art structure which stacks the components.

It is considered that delivery accuracy lowers due to deterioration of restoration of the tube after the tube is kept closed with pressure for a long period. In this structure which separates the tube included in the tube unit from the fingers included in the control unit for closing the tube, the tube within the tube unit is kept opened. Thus, lowering of the delivery accuracy caused by deterioration of restoration by continuous closing of the tube is prevented, and desired delivery accuracy can be maintained.

It is also considered that restoration of the tube lowers by repeating close and open conditions of the tube for a long period. In this case, the tube needs to be replaced. In this structure, the tube can be easily replaced as the tube unit after use for a certain period.

The tube unit is constituted by the tube and the tube guide frame. Thus, the cost of the tube unit is considerably lower than that of the control unit including the plural fingers, the cam, the drive unit, and the control circuit unit. Accordingly, the running cost can be reduced by making the tube unit which includes the tube directly contacting liquid medicine disposable and using the control unit repeatedly.

According to this structure, the plural fingers can be brought into a condition for pressing the tube by attaching the tube unit to the control unit in the horizontal direction. Thus, a connection mechanism between the motor module and the pump module required in the related art is not needed, and simplification and assembly of the structure can be increased.

According to a second aspect of the invention, it is preferable that the tube unit is attached to the inside of a space formed by the device frame and closed within the space.

According to this structure, the device frame constituting the control unit has function of a case. Thus, a case for accommodating the tube unit and the control unit is not required, contributing to simplification of the structure and reduction of the thickness of the micropump.

Moreover, the number of connections on the external shape portion is reduced. Thus, the closeness (waterproofness) of the interiors of the tube unit and the control unit increases.

According to a third aspect of the invention, it is preferable that the tube guide frame has a tube guide groove into which the tube is inserted, and a tube supporting portion for supporting the tube inside the tube guide groove.

The micropump transports fluid by repeatedly closing and opening the tube using the plural fingers. Thus, the range of the tube pressed by the fingers needs to be determined with the position of the tube accurately regulated.

The position of the major part of the tube can be accurately regulated by controlling the position of the tube in the horizontal direction using the tube guide groove and supporting the range of the tube pressed by the fingers using the tube supporting portion.

According to a fourth aspect of the invention, it is preferable that the tube supporting portion is a projection formed on a part of the side wall of the tube guide groove in the direction in which the plural fingers are disposed.

It is difficult to form the continuous side wall of the tube guide groove on the fingers side in the range of the tube pressed by the plural fingers. Thus, the position of the tube can be regulated by the projection in the shape of the side wall disposed in the areas between the respective fingers.

When a projection continued from the projection in the form of the side wall and projecting above the tube (with respect to the tube guide groove) is provided, rising of the tube can be prevented.

According to a fifth aspect of the invention, it is preferable that the tube supporting portion is a tube supporting member disposed along the inside of the circular-arc shape of the tube.

As explained above, it is difficult to form the continuous side wall of the tube guide groove on the fingers side. Thus, the position of the tube can be regulated by the tube supporting member thus provided.

When the tube supporting member is made of metal, the thickness of the tube supporting member can be reduced. Thus, the tube supporting member can be disposed in a narrow space leaving sufficient rigidity.

According to a sixth aspect of the invention, it is preferable that the tube supporting member has openings through which each of the plural fingers is inserted.

According to this structure, a part of the tube supporting member is left between the respective openings. Thus, the tube supporting portion can be formed between the respective fingers.

According to a seventh aspect of the invention, it is preferable that the tube supporting member is an extendable sheet.

The sheet herein is constituted by silicon wrap, for example.

The extendable silicon wrap extends when the tube is pressed by the fingers without imposing load for preventing shift of the fingers, and follows the movement of the fingers in the axial direction. Thus, a continuous tube guide portion can be formed on the fingers side.

According to an eighth aspect of the invention, it is preferable that a guide portion which disposes the center of the circular-arc shape of the tube and the rotation center of the cam substantially at the same position when the tube unit is attached to the control unit is provided on the tube unit and the control unit.

The micropump according to the aspect of the invention closes the tube by the plural fingers in accordance with rotation of the cam. Thus, the center of the circular-arc shape of the tube and the rotation center of the cam need to be disposed substantially at the same position.

According to this structure, the center of the circular-arc shape of the tube and the rotation center of the cam can be located substantially at the same position by providing the guide portions on both the tube unit and the control unit when the tube unit is attached to the control unit. Thus, all the plural fingers can securely close the tube without using a dedicated position regulating component.

According to a ninth aspect of the invention, it is preferable that a detection unit which detects that the center of the circular-arc shape of the tube and the rotation center of the cam have been disposed substantially at the same position is provided between the tube unit and the control unit when the tube unit is attached to the control unit.

According to this structure, the motor can be operated when it is detected that the center of the circular-arc shape of the tube almost agrees with the rotation center of the cam. Thus, all of the plural fingers have the same level of closing, and fluid can be transported with a desired flow amount per unit time.

According to a tenth aspect of the invention, it is preferable that the device frame has finger guide holes to which each of the plural fingers are attached. Each of the plural fingers has a shaft to be attached to the corresponding finger guide hole, and a fringe-shaped tube pressing portion larger than the finger guide hole. The plural fingers have a separation preventing mechanism which prevents separation of the fingers from the finger guide holes in the axial direction.

The finger guide holes are through holes allowing the fingers to freely advance and retreat. Thus, there is a possibility that the fingers separate from the finger guide holes before the tube unit is attached. Separation of the fingers can be prevented by the separation preventing mechanism thus provided.

According to an eleventh aspect of the invention, it is preferable that the separation preventing mechanism has projections which reduce the finger guide holes. Each of the plural fingers has a groove in the circumferential direction of the shaft. The projections are attached to the grooves to regulate shift of the plural fingers in the axial direction.

According to this structure, shift of the fingers in the axial direction is regulated by the grooves provided on the shafts in the circumferential direction and the projections provided on the finger guide holes. Thus, separation of the fingers from the finger guide holes can be prevented, and assembly can be facilitated.

According to a twelfth aspect of the invention, it is preferable that each of the plural fingers has a stopper fringe disposed on the shaft at the end opposite to the tube pressing portion or at an intermediate position and larger than the finger guide hole. Shift of the plural fingers in the axial direction is regulated by the tube pressing portions and the stopper fringes, or concaves formed at intermediate positions of the finger guide holes in the axial direction for accommodating the stopper fringes.

According to this structure, shift of the fingers in the axial direction can be regulated between the tube pressing portions and the stopper fringes or between the concaves and the stopper fringes. Thus, separation of the fingers from the finger guide holes can be prevented.

According to a thirteenth aspect of the invention, it is preferable that the micropump includes a tube regulating wall disposed on the tube guide frame and pressed by the plural fingers to regulate shift of the tube, and an elastic member disposed between the tube and the tube regulating wall.

During press against the tube by the fingers, excessive pressing force is absorbed by the elastic member. By this method, durability of the tube becomes higher than that of a structure which directly presses the tube against the tube guide wall.

It is more effective to use the elastic member made of material having a small coefficient of friction.

According to a fourteenth aspect of the invention, it is preferable that the micropump further includes a cover member which fixes the tube unit to the control unit, and an elastic member disposed between the cover member and the tube unit to urge the tube unit toward the control unit such that the center of the circular-arc shape of the tube and the rotation center of the cam almost agree with each other.

When the tube unit is fixed to the control unit by the cover member, there is a possibility that the tube cannot be closed by the fingers by presence of a space in the horizontal direction between the tube unit and the control unit caused by size variations of the components.

In this structure, the guide portion of the tube unit is brought into contact with the guide portion of the control unit by urging the tube unit toward the control unit using the elastic member. In this case, the center of the circular-arc shape of the tube and the rotation center of the cam almost agree with each other, and thus the fingers can securely close the tube.

According to a fifteenth aspect of the invention, it is preferable that the elastic force of the elastic member is larger than the tube pressing force of the plural fingers.

According to this structure, the tube unit (i.e., the tube) does not shift away from the fingers when the fingers press the tube. Thus, the tube can be securely closed.

According to a sixteenth aspect of the invention, it is preferable that a part or all part of the device frame and the tube guide frame is transparent.

In this structure, the inside components or the engagements and driving conditions of the respective components can be visually checked through the transparent material to judge whether the normal condition has been achieved or detect where problems are produced. Further, the amount of liquid in the reservoir can be visually checked. The range of transparency may be provided only in the part desired to be visually checked.

According to a seventeenth aspect of the invention, it is preferable that the power source is accommodated in the tube unit.

For reducing the size of the micropump, a miniature button type battery or a sheet type battery is used as the power source.

In case of change of liquid medicine used or replacement of the tube after long-term use, the capacity of the battery does not run short in the middle of use by replacing the battery together with the tube as the tube unit.

According to an eighteenth aspect of the invention, it is preferable that the power source is detachably attached to the tube unit.

It is expected that the capacity of the battery runs short in the middle of the use period when the miniature battery is used as the power source. According to this structure, the battery can be easily and separately replaced. Thus, the micropump can be continuously used for a long time.

According to a nineteenth aspect of the invention, it is preferable that the reservoir is detachably attached to the tube.

It is expected that liquid medicine contained in the reservoir runs short during use of the micropump. In this case, the micropump can be used for a long time by connecting the reservoir containing liquid medicine to the tube after detaching the reservoir from the tube for replenishment.

According to a twentieth aspect of the invention, it is preferable that the reservoir is accommodated in the tube unit.

When the tube unit including the tube is replaced at the time of the end of fluid contained in the reservoir, the tube can be replaced as the tube unit before deterioration of the tube which may be caused by repetitive close with pressure and open conditions for a long period. As a result, reliability of the micropump improves.

According to a twenty-first aspect of the invention, it is preferable that the reservoir and the power source are accommodated in the tube unit.

The tube unit is attached to the inside of the device frame of the control unit. Thus, the reservoir and the power source (battery) contained in the tube unit are also accommodated within the control unit.

According to this structure, the actual functions necessary for the micropump are contained in the device frame, and thus the size of the micropump is reduced. Since no component projects from the device frame, the micropump can be easily handled and thus is appropriately used when attached inside a living body.

Moreover, the battery can be replaced at the time of replacement of the reservoir or the tube as the tube unit. Thus, reliability can be further increased.

Furthermore, long lead and battery case necessary for connection with the battery when the battery is disposed outside the micropump are not required in this structure.

According to a twenty-second aspect of the invention, it is preferable that the reservoir has a port for introducing and sealing fluid.

The port is constituted by a septum, for example.

By providing a septum on the reservoir, additional fluid can be easily injected into the reservoir with the tube connected.

According to a twenty-third aspect of the invention, it is preferable that the reservoir is accommodated in the tube unit, and that the port is supported on an opening formed on the tube guide frame with close contact such that the inlet portion of the port can project from the outside of the tube guide frame.

In this structure, additional fluid can be easily injected into the reservoir contained in the tube unit. Moreover, additional fluid can be injected even while the tube unit is attached to the control unit. Furthermore, additional fluid can be easily injected even while the micropump is operating.

Since the port is closely fixed to the tube guide frame, entrance of liquid through the space between the port and the tube guide frame can be prevented.

According to a twenty-fourth aspect of the invention, it is preferable that the micropump further includes an air-bent filter provided on the communicating portion between the reservoir and the tube to block passage of a bubble.

There is a possibility that air is dissolved in fluid contained in the reservoir. In this case, it is expected that the dissolved air gathers with elapse of time and becomes bubbles. When fluid is liquid medicine and is injected into a living body, the liquid medicine containing bubbles may cause problems which cannot be overlooked.

According to this structure, however, the air-bent filter which transmits liquid and blocks passage of bubbles is provided. Thus, injection of bubbles into the living body can be prevented, and safety can be enhanced.

A twenty-fifth aspect of the invention is directed to a control unit detachable and attachable to a tube unit which contains a tube having a circular-arc-shaped part and elasticity and a tube guide frame for supporting the tube including: a plurality of fingers extending from the center of the circular-arc shape of the tube in radial directions; a cam for sequentially pressing the plural fingers from the inlet port side to the outlet port side of the tube; a drive unit for giving rotation force to the cam; a control circuit unit for controlling operation of the drive unit; and a device frame for supporting the plural fingers, the cam, and the drive unit. The control unit is detachably attached to the tube unit substantially in the horizontal direction with respect to the rotation surface of the cam.

According to this structure, the control unit includes elements associated with a motor as the drive source, the cam, the plural fingers, and the control circuit unit. Thus, operation can be checked as the control unit. Moreover, no connection mechanism between the respective drive elements is needed, and operation condition can be instantly produced by slidingly attaching the tube unit to the control unit.

A twenty-sixth aspect of the invention is directed to a tube unit detachable and attachable to a control unit which contains a cam, a plurality of fingers extending from the rotation center of the cam in radial directions, a drive unit for giving rotation force to the cam, a control circuit unit for controlling operation of the drive unit, and a device frame for supporting the cam, the plural fingers, the drive unit, and the control circuit unit including: a tube provided in such a position that the rotation center of the cam and the center of the circular-arc shape of the tube almost agree with each other; and a tube guide frame which holds the tube. The tube unit is detachably attached to the control unit substantially in the horizontal direction to the rotation surface of the cam.

According to this structure, the tube contained in the tube unit is kept opened. Thus, lowering of delivery accuracy caused by deterioration of restoration by maintaining the tube in the closed condition can be prevented.

It is also considered that restoration of the tube lowers by repeating close and open conditions of the tube for a long period. In this structure, the tube can be easily replaced as the tube unit after use for a certain period.

The tube unit is constituted by the tube and the tube guide frame. Thus, the cost of the tube unit is considerably lower than that of the control unit having the structure described above. Accordingly, the running cost can be reduced by making the tube unit which includes the tube directly contacting liquid medicine disposable.

According to a twenty-seventh aspect of the invention, it is preferable that the tube unit accommodates the reservoir communicating with an inlet port of the tube.

According to this structure, the reservoir is accommodated in the tube unit. Thus, the tube unit containing the reservoir can be easily handled. Moreover, the length of the tube can be reduced by connecting the reservoir and the tube inside the tube unit.

Moreover, by replacing the tube unit including the tube at the time of the end of fluid contained in the reservoir, the tube can be replaced as the tube unit before deterioration of the tube which may be caused by repetitive close and open conditions for a long period. As a result, reliability of the micropump improves.

According to a twenty-eighth aspect of the invention, it is preferable that the tube unit contains a power source which supplies power to the control circuit unit.

For reducing the size of the tube unit, a miniature button type battery or a thin coin type battery is used as the power source.

When changing liquid medicine used, the battery can be replaced at the time of replacement of the tube as the tube unit after long-term use. Thus, insufficiency of the capacity of the battery can be prevented in the middle of the use period.

According to a twenty-ninth aspect of the invention, it is preferable that the tube unit contains a reservoir communicating with an inlet port of the tube, and a power source for supplying power to the control circuit unit.

According to this structure, the battery can be replaced at the time of replacement of the reservoir or the tube as the tube unit. Thus, reliability can be further increased.

BRIEF DESCRIPTION OF THE DRAWINGS

The invention will be described with reference to the accompanying drawings, wherein like reference numbers are given to like elements.

FIG. 8A is a partial cross-sectional view illustrating a micropump in a first example, and FIG. 8B is a partial cross-sectional view illustrating a micropump in a second example.

FIG. 9A is a plan view illustrating a part of the micropump, FIG. 9B is a cross-sectional view taken along a line B-B in FIG. 9A, and FIG. 9C is a cross-sectional view taken along a line D-D in FIG. 9A.

FIG. 10A is a partial plan view, and FIG. 10B is a cross-sectional view taken along a line E-E in FIG. 10A.

FIG. 11A is a partial plan view, and FIG. 11B is a cross-sectional view taken along a line G-G in FIG. 11A.

FIG. 12A is a partial plan view, and FIG. 12B is a cross-sectional view taken along a line H-H in FIG. 12A.

DESCRIPTION OF EXEMPLARY EMBODIMENTS

Exemplary embodiments according to the invention are hereinafter described with reference to the drawings.

Figure 8A:
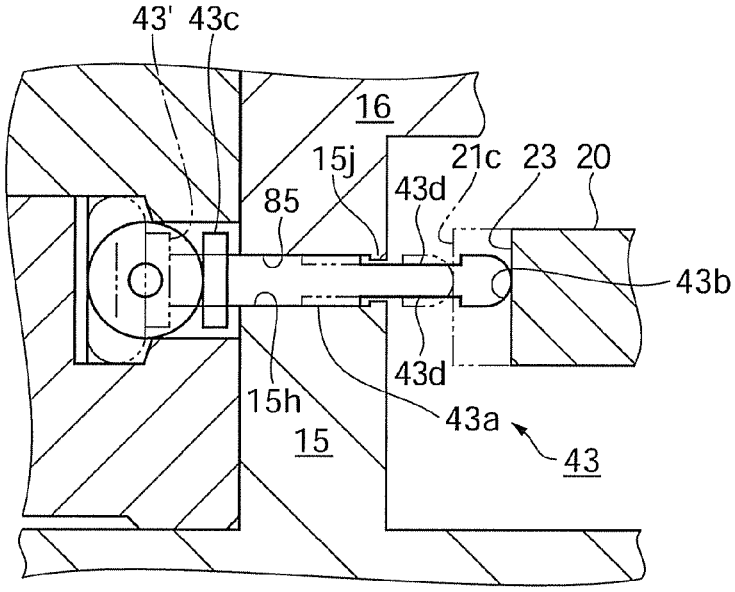
FIGS. 8A and 8B illustrate a micropump according to a second embodiment.
Figure 8B:
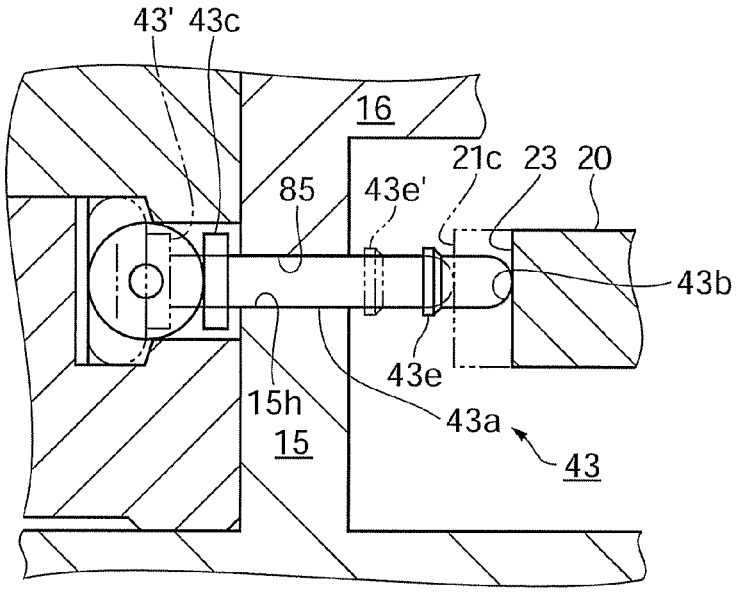
Figure 9A:
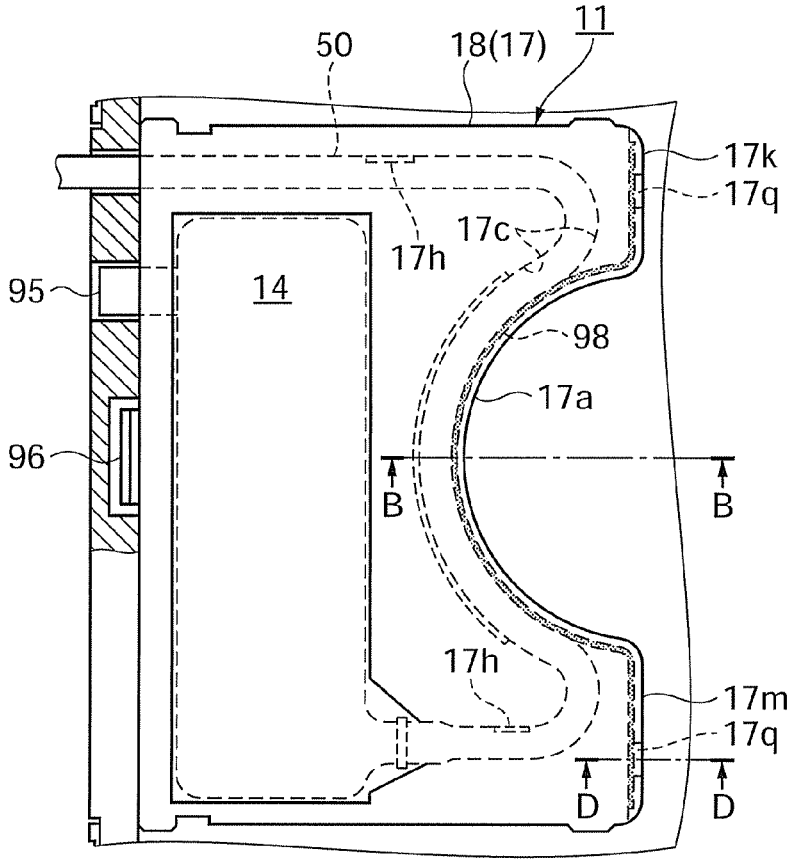
FIGS. 9A through 9C illustrate a micropump according to a third embodiment.
Figure 9B:
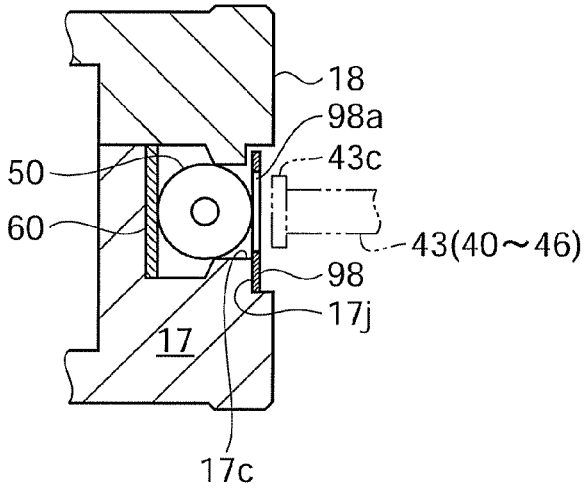
Figure 9C:
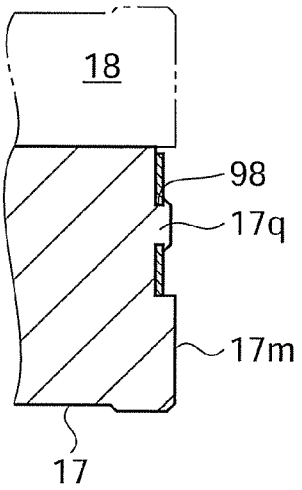
Figure 10A:
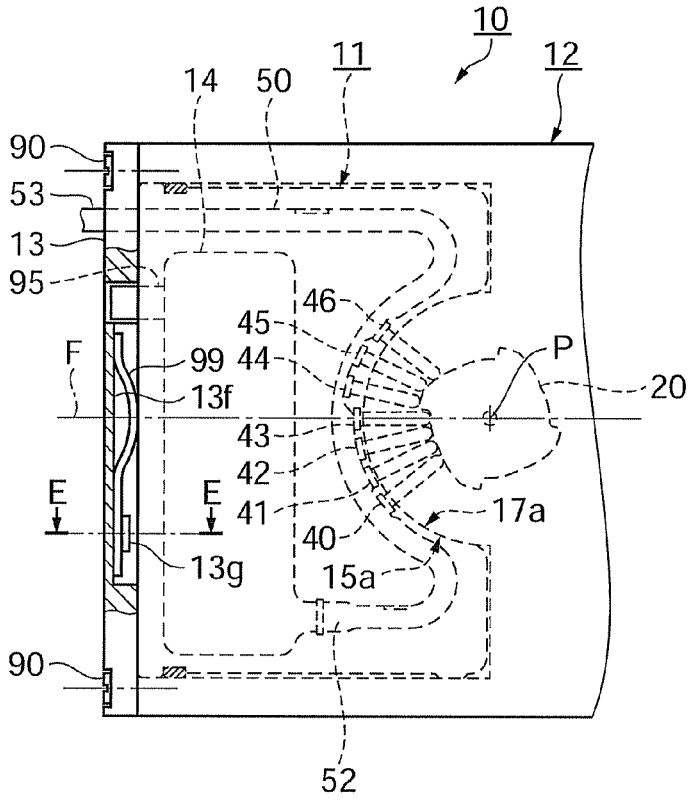
FIGS. 10A and 10B illustrate a micropump according to a fourth embodiment.
Figure 10B:
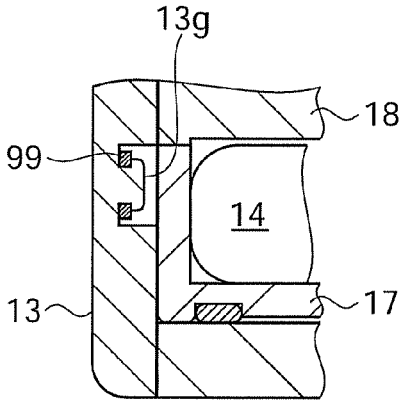
Figure 11A:
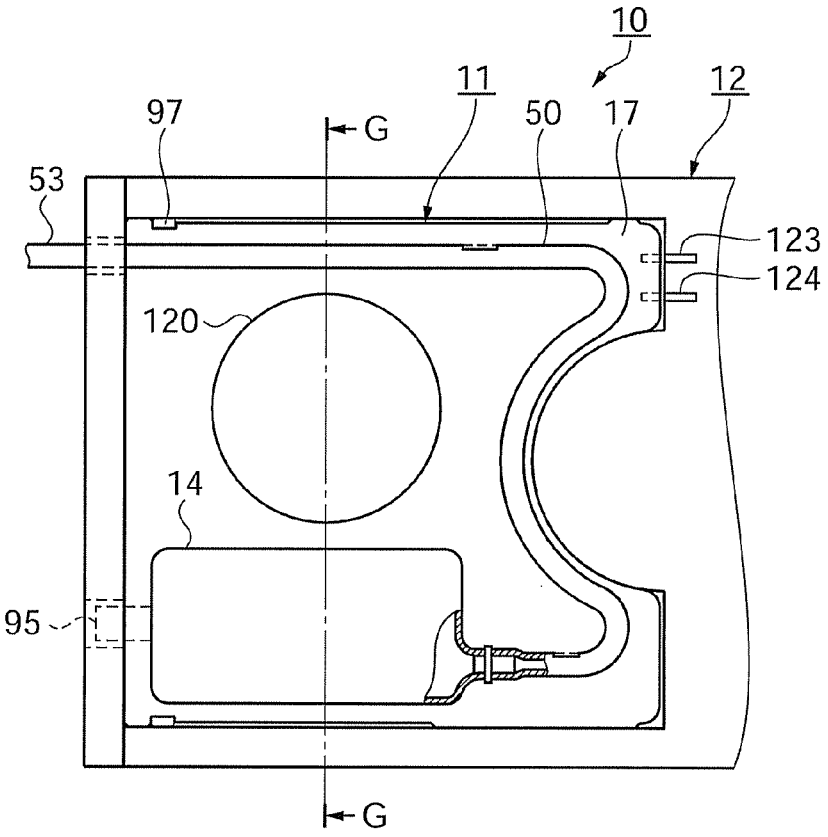
FIGS. 11A and 11B illustrate a micropump according to a fifth embodiment.
Figure 11B:
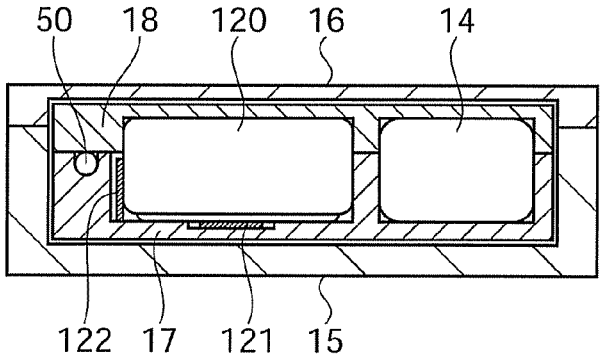
Figure 12A:
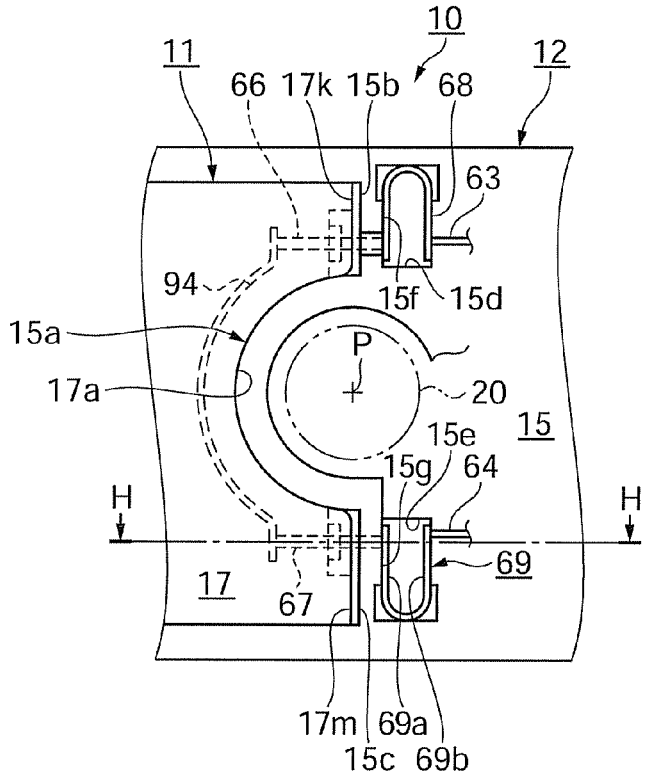
FIGS. 12A and 12B illustrate a micropump according to a sixth embodiment.
Figure 12B:
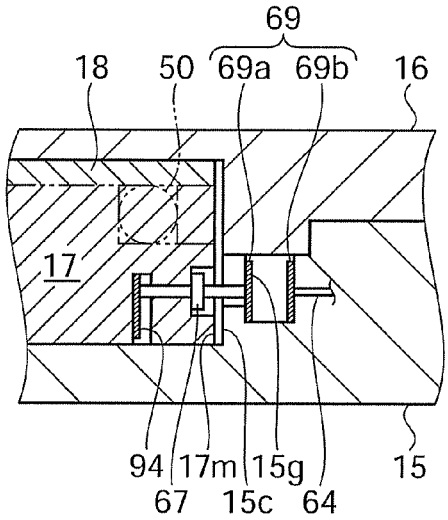

FIGS. 1 through 7 illustrate a micropump according to a first embodiment. FIGS. 8A and 8B illustrate a second embodiment. FIGS. 9A through 9C illustrate a third embodiment. FIGS. 10A and 10B illustrate a fourth embodiment. FIGS. 11A and 11B illustrate a fifth embodiment. FIGS. 12A and 12B illustrate a sixth embodiment.

The figures referred to in the following explanation are schematic figures having vertical and horizontal reduction scales not representing the practical sizes of the parts and components for easy understanding of the figures.

First Embodiment

Figure 1:
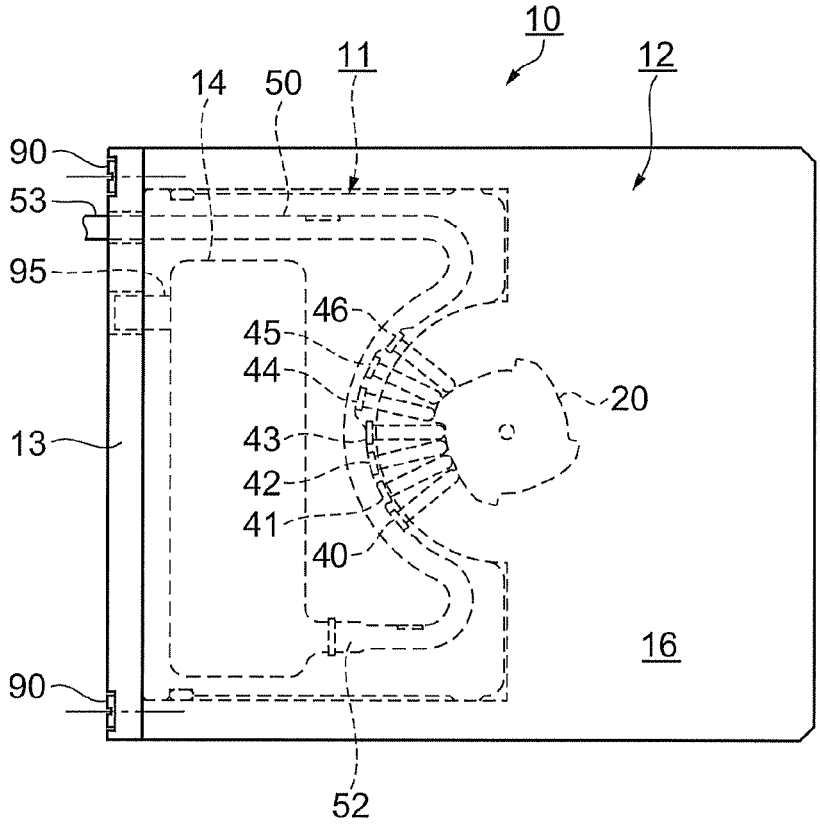
FIG. 1 is a plan view illustrating a general appearance of a micropump according to a first embodiment.
Figure 2:
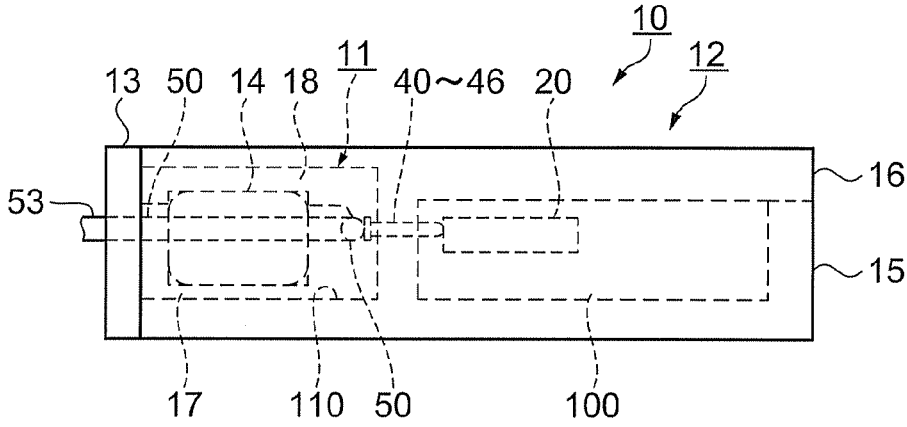
FIG. 2 is a front view illustrating a general appearance of the micropump according to the first embodiment.

FIG. 1 is a plan view illustrating a general appearance of a micropump according to the first embodiment. FIG. 2 is a front view illustrating the general appearance of the micropump in this embodiment. As shown in FIGS. 1 and 2, a micropump 10 is a one-piece device produced by slidingly inserting a tube unit 11 through an opening formed on the left side surface of a control unit 12 as viewed in the figure and fixing the tube unit 11 to the control unit 12 by a fixing frame 13 as a cover member using fixing screws 90.

The tube unit 11 has a tube 50 having elasticity and a circular-arc part, a first tube guide frame 17 and a second tube guide frame 18 as tube guide frames for holding the tube 50, and a reservoir 14 communicating with an inlet port 52 of the tube 50 to contain fluid. In the following explanation, the fluid is liquid such as liquid medicine.

The control unit 12 has a cam 20, a motor and a transmission mechanism (not shown) as a drive unit for giving rotational force to the cam 20, a control circuit unit (not shown) for controlling drive of the motor, and a plurality of fingers 40 through 46.

The cam 20, the motor, the transmission mechanism, the fingers 40 through 46, and the control circuit unit are supported by a first device frame 15 and a second device frame 16 provided as device frames.

One end of the tube 50 is an outlet port 53 which penetrates through the fixing frame 13 and projects to the outside to deliver liquid from the reservoir 14 to the outside.

A septum 95 as a port for injecting liquid into the reservoir 14 and sealing the liquid is provided on a part of the reservoir 14. The septum 95 projects from the fixing frame 13.

The structures of the tube unit 11, the control unit 12, and the fixing frame 13, and the assembly method are now discussed.

Figures 3A, 3B, 3C:
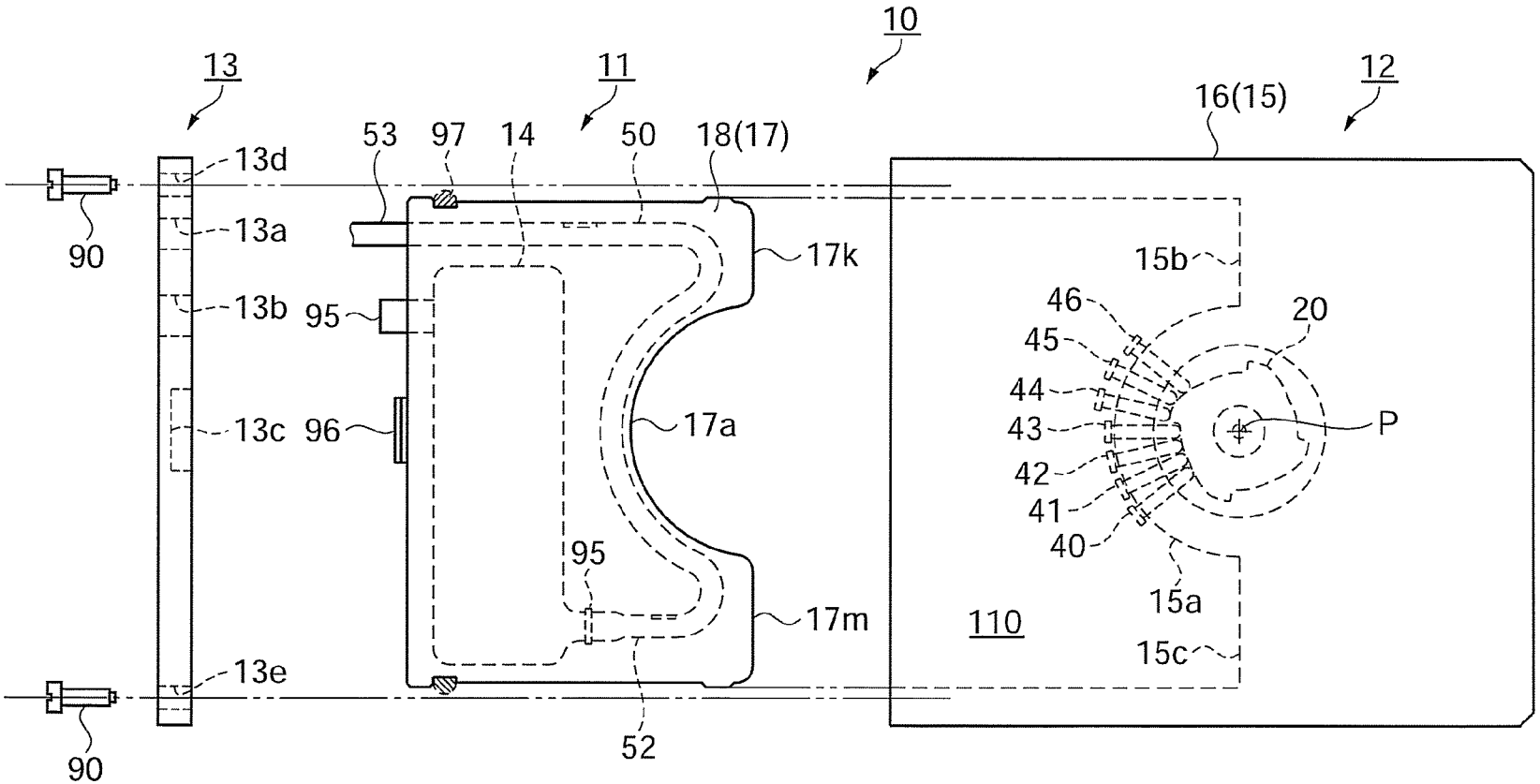
FIG. 3 is a plan view illustrating the disassembled micropump according to the first embodiment.
Figures 4A, 4B, 4C:
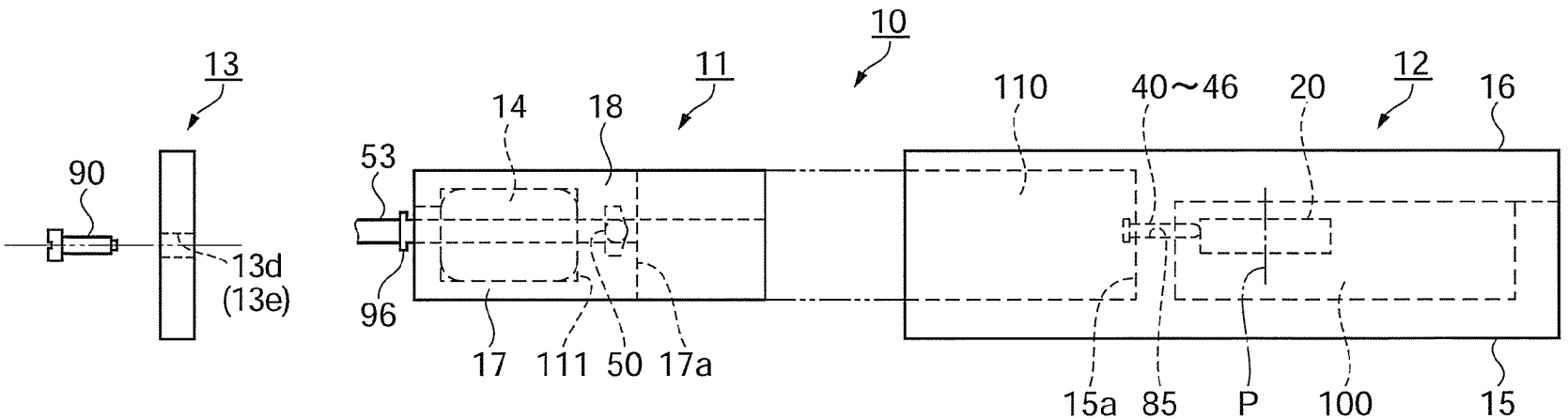
FIG. 4 is a front view illustrating the disassembled micropump according to the first embodiment.

FIG. 3 is a plan view showing the disassembled micropump. FIG. 4 is a front view showing the disassembled micropump. In FIGS. 3 and 4, parts (a) show the fixing frame 13, parts (b) show the tube unit 11, and parts (c) show the control unit 12.

As illustrated in FIGS. 3 and 4, spaces 100 and 110 are produced in the control unit 12 by the first device frame 15 and the second device frame 16. The closed space 100 is a space which contains the cam 20, the motor, the transmission mechanism, and the control circuit unit (not shown). The space 110 having an opening on one side is a space into which the tube unit 11 is inserted.

The fingers 40 through 46 are attached to finger guide holes 85 formed by the first device frame 15 and the second device frame 16 which penetrate a wall for separating the space 100 and the space 110. One ends of the fingers 40 through 46 project toward the space 100 and contact the cam 20. The other ends of the fingers 40 through 46 project toward the space 110 to close the tube 50 with pressure when the tube unit 11 is inserted.

The tube unit 11 is inserted into the space 110 of the control unit 12 from the left in the figure under the condition in which the tube 50 and the reservoir 14 communicating with each other are held by the first tube guide frame 17 and the second tube guide frame 18.

The cam 20 rotates around an axis of a rotation center P. Thus, the tube unit 11 is inserted into the control unit 12 in the direction parallel with the rotation surface of the cam 20.

A packing 97 is provided along the outer circumference of the tube unit 11 in the vicinity of the fixing frame 13 to close the space 110 after the tube unit 11 is inserted into the control unit 12.

The tube unit 11 is pushed into the control unit 12 until a circular-arc-shaped wall surface 17*a* of the tube unit 11 contacts a circular-arc-shaped wall surface 15*a* projecting from the control unit 12. The wall surfaces 15*a* and 17*a* have concentric circle shapes with respect to the rotation center P of the cam 20.

Figure 5:
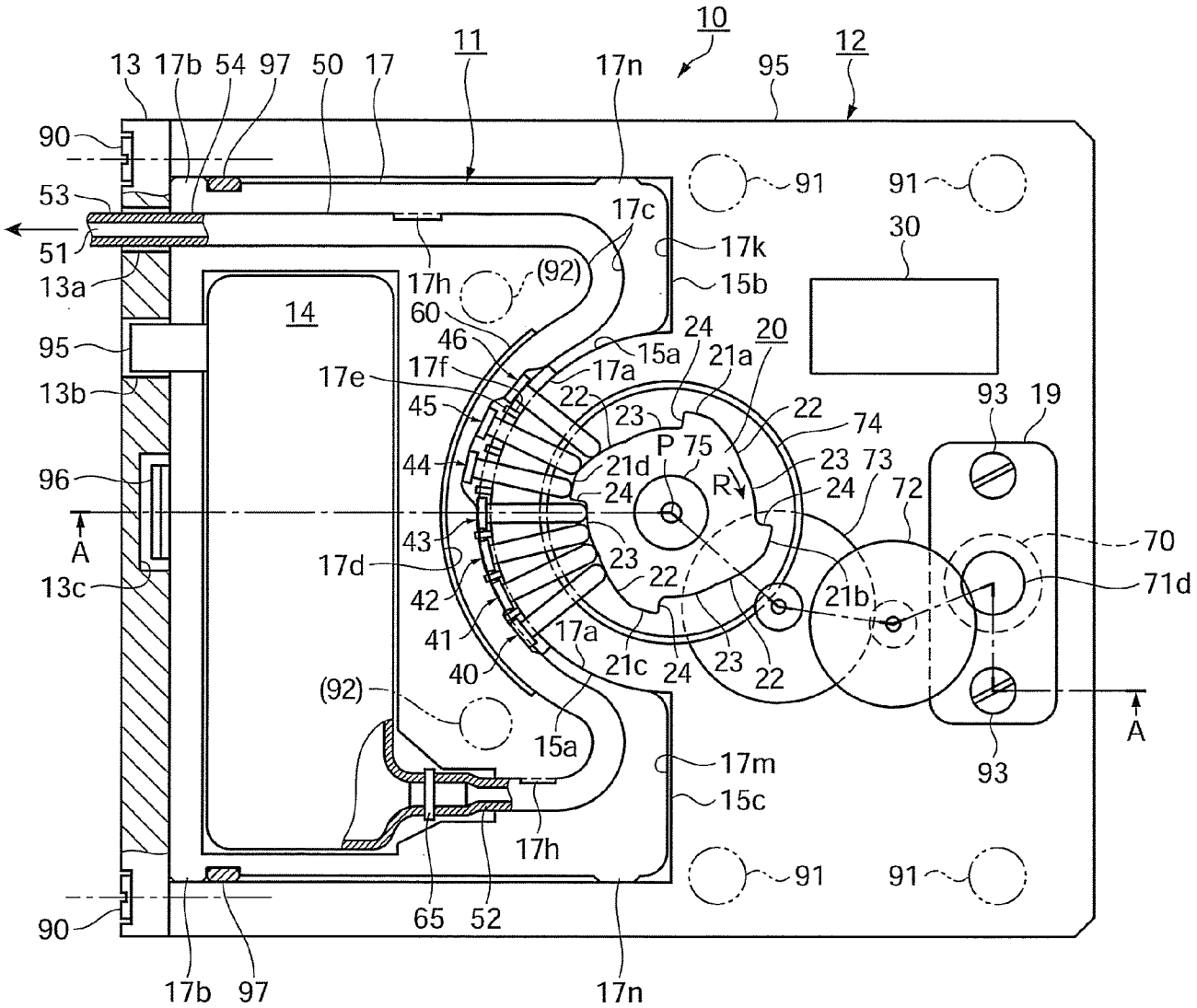
FIG. 5 is a plan view illustrating the micropump according to the first embodiment.

The lengths of control unit side ends 17*k* and 17*m* of the tube unit 11 are determined such that a space can be produced between the ends 17*k* and 17*m* and inner side walls 15*b* and 15*c* of the control unit 12 under the condition of contact between the wall surface 15*a* and the wall surface 17*a* (see FIG. 5 as well).

By this arrangement, the wall surface 15*a* and the wall surface 17*a* securely contact each other, and the circular-arc center of the circular-arc portion of the tube 50 (area pressed by the fingers 40 through 46) agrees with the rotation center P of the cam 20.

After the tube unit 11 is inserted into the control unit 12, the fixing frame 13 is attached to the tube unit 11 from the back of the tube unit 11. More specifically, the fixing screws 90 are inserted into through holes 13*d* and 13*e* formed on the fixing frame 13 to be screwed into screw holes (not shown) formed on the first device frame 15 of the control unit 12.

The outlet port 53 of the tube 50 and the septum 95 provided on the reservoir 14 project from the tube unit 11. When the fixing frame 13 is fixed, the tube 50 and the septum 95 are inserted into a tube insertion hole 13*a* and a septum insertion hole 13*b*, respectively. In this condition, the outlet port 53 extends to the outside of the fixing frame 13.

A projection 96 is formed at the end of the first tube guide frame 17. The projection 96 is used when the tube unit 11 is removed from the control unit 12. The projection 96 is accommodated in a concave portion 13*c* formed on the fixing frame 13.

The structures and operations of the respective elements of the micropump 10 assembled as described above are now discussed with reference to the drawings.

Figure 6A:
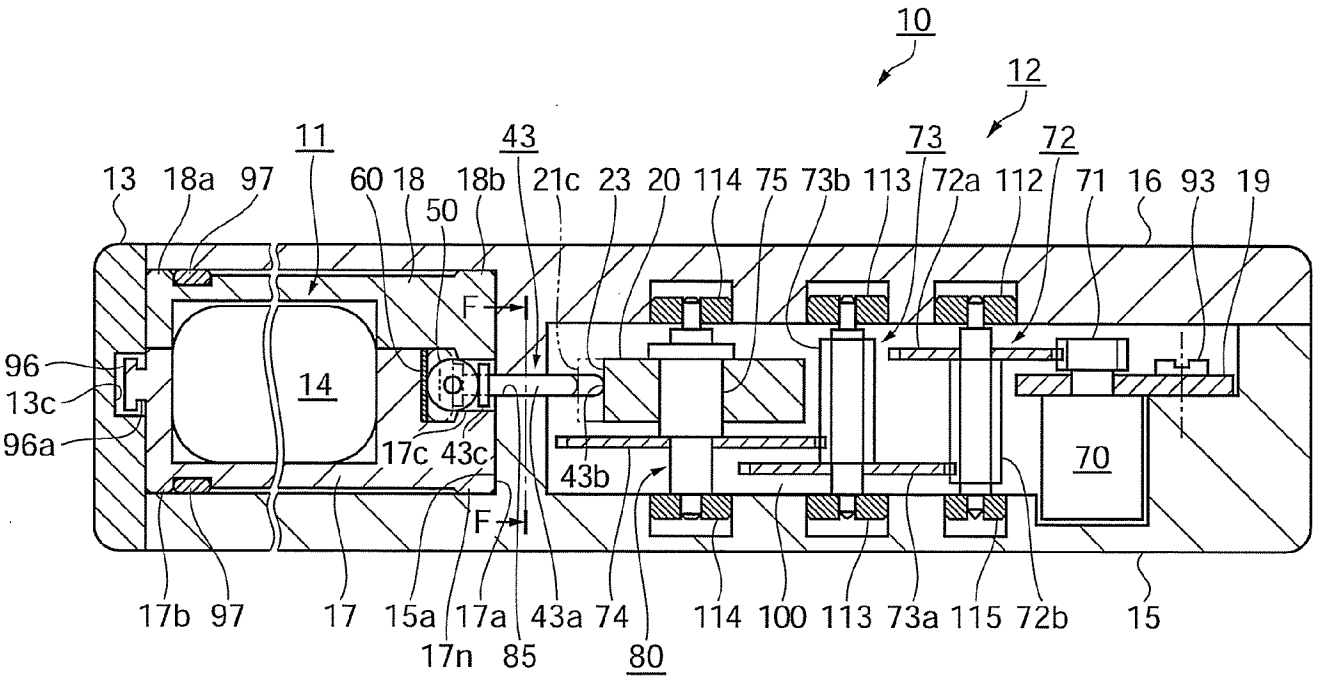
FIG. 6A is a cross-sectional view taken along a line A-P-A in FIG. 5.
Figure 6B:
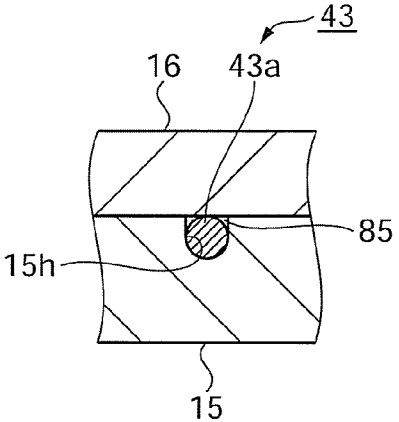
FIG. 6B is a cross-sectional view taken along a line F-F in FIG. 6A.
Figure 7:
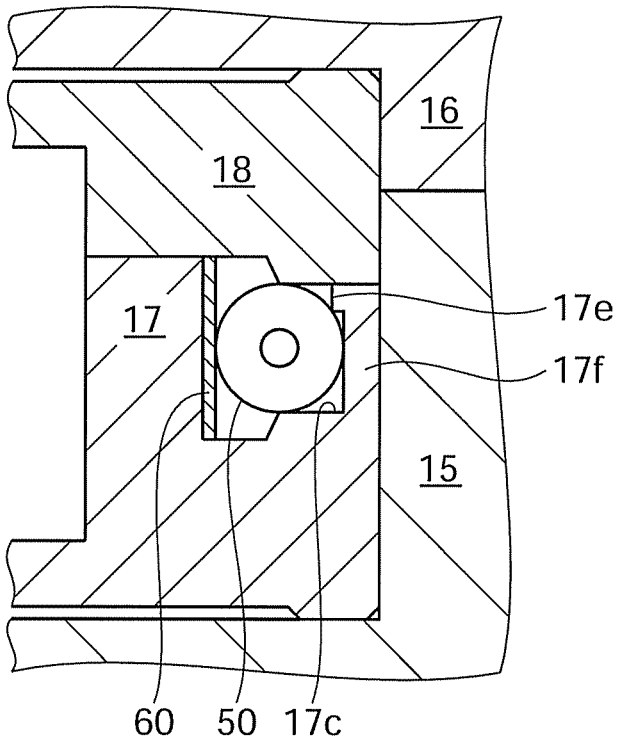
FIG. 7 is a cross-sectional view illustrating a part of the micropump according to the first embodiment.

FIGS. 5 through 7 illustrate the micropump according to this embodiment. FIG. 5 is a plan view. FIG. 6A is a cross-sectional view taken along a line A-P-A in FIG. 5. FIG. 6B is a cross-sectional view taken along a line F-F in FIG. 6A. FIG. 7 is a partial cross-sectional view. Initially, the structure of a drive unit is explained with reference to FIG. 5 and FIGS. 6A and 6B. FIG. 5 illustrates the micropump as viewed through the second device frame 16 and the second tube guide frame 18.

The drive unit has a step motor 70 as a motor to transmit the rotation of the step motor 70 to a cam drive gear 74 via a transmission mechanism (motor gear 71, first transmission wheel 72, and second transmission wheel 73).

The step motor 70 is supported by a motor supporting frame 19, and fixed to the first device frame 15 by fixing screws 93. The step motor 70 has the motor gear 71.

The first transmission wheel 72 and the second transmission wheel 73 are rotatably supported by the first device frame 15 and the second device frame 16.

The first transmission wheel 72 is supported by a bearing 115 provided on the first device frame 15 and a bearing 112 provided on the second device frame 16 with a transmission gear 72*a* engaging with a pinion 72*b*.

The second transmission wheel 73 is supported by a bearing 113 provided on the first device frame 15 and a bearing 113 provided on the second device frame 16 with a transmission gear 73*a* engaging with a pinion 73*b*.

The cam drive gear 74 and the cam 20 engaging with a cam shaft 75 constitute a cam drive wheel 80. The cam drive gear 74 is supported by a bearing 114 provided on the first device frame 15 and a bearing 114 provided on the second device frame 16. The tooth number ratio of the respective gears, and predetermined rotation speed and rotation torque of the cam 20 are determined such that decelerating drive can be achieved from the motor gear 71 to the cam drive gear 74.

The step motor 70, the first transmission wheel 72, the second transmission wheel 73, and the cam drive wheel 80 are disposed within the space 100 formed by the first device frame 15 and the second device frame 16. The interior of the space 100 is closed by bringing the connection surfaces of the first device frame 15 and the second device frame 16 into close contact with each other.

Connection between the first device frame 15 and the second device frame 16 is achieved by a fixing structure using fixing screws 91 shown in FIG. 5, by depositing or bonding the respective connection surfaces, or by other methods.

The control unit 12 has a control circuit unit 30 connected with the step motor 70 via a circuit pattern provided on a not-shown circuit board such that the step motor 70 can rotate at predetermined rotation speed.

The cam 20 has concaves and convexes on the outer circumference, and has finger pressing surfaces 21*a* through 21*d* on the outermost circumference. The finger pressing surfaces 21*a* through 21*d* are disposed on a concentric circle at equal distance from the rotation center P.

The pairs of the finger pressing surface 21*a* and the finger pressing surface 21*b*, the finger pressing surface 21*b* and the finger pressing surface 21*c*, the finger pressing surface 21*c* and the finger pressing surface 21*d*, and the finger pressing surface 21*d* and the finger pressing surface 21*a* have the same pitch in the circumferential direction and the same external shape.

The finger pressing surfaces 21*a* through 21*d* are formed continuously from finger pressing slopes 22 and circular-arc portions 23 on a concentric circle around the rotation center P. The circular-arc portions 23 are disposed at positions not pressing the fingers 40 through 46.

One ends of the finger pressing surfaces 21*a*, 21*b*, 21*c*, and 21*d* are connected with the circular-arc portions 23 by linear portions 24 extended from the rotation center P.

The fingers 40 through 46 are attached to the finger guide holes 85 which penetrate the space 100 and the space 110 of the first device frame 15 (see FIG. 2) at equal intervals in radial directions from the rotation center P. Since the fingers 40 through 46 have the same shape, only the finger 43 is herein discussed as an example.

As shown in FIG. 6B, the finger guide hole 85 forms a substantially U-shaped groove 15*h* on the first device frame 15, and the upper opening of the finger guide hole 85 as viewed in the figure is sealed by the second device frame 16.

The position of the finger 43 in the cross-sectional direction is regulated by attaching the second device frame 16 to the first device frame 15 from above after a shaft 43*a* is attached to the groove 15*h* from the opening side. The finger 43 may be inserted into the finger guide hole 85 from the tube unit 11 side depending on the condition of the control unit 12.

The finger 43 has the cylindrical shaft 43*a*, a fringe-shaped tube pressing portion 43*c* provided at one end of the shaft 43*a*, and a cam contact portion 43*b* as the other end having hemispherical shape. The fingers 40 through 46 can shift along the finger guide holes 85 in the axial direction.

The tube unit 11 is now discussed with reference to FIG. 5 and FIGS. 6A and 6B. The tube 50 has a circular-arc portion facing the cam 20, and is attached to a tube guide groove 17*c* of the first tube guide frame 17.

The center of the circular-arc shape of the tube 50 almost coincides with the rotation center P of the cam 20. One end of the tube 50 communicating with the reservoir 14 is the outlet port 53 extended through a tube insertion hole 13*a* of the fixing frame 13.

The horizontal shape and position of the tube 50 are regulated by attaching the approximately entire part of the tube 50 into the guide groove 17*c*. Also, projections as tube supporting portions are provided on a part of the inner side wall of the tube guide groove 17*c* to prevent upward shift of the tube 50.

FIG. 7 is a cross-sectional view illustrating a part of the projections discussed above. FIG. 7 shows the projection provided between the finger 45 and the finger 46 as an example of the projections formed between each adjoining pairs of the fingers 40 through 46 (see FIG. 5 as well).

The tube guide groove 17*c* does not have a side wall continuously formed on the fingers side so as not to prevent advance and retreat of the fingers 45 and 46. Thus, a tube guide side wall 17*f* is provided between the fingers 45 and 46 as a projection having a width not preventing advance and retreat of the fingers 45 and 46, and a projection 17*e* projecting toward a part of the upper region of the tube 50 is provided on the upper area of the tube guide side wall 17*f*.

By disposing the tube guide side walls 17*f* and the projections 17*e* between the respective fingers 40 through 46, regulation of the position of the tube 50 in the horizontal direction and prevention of rising of the tube 50 can be achieved within the range of the positions of the fingers 40 through 46.

In this embodiment, projections 17*h* similar to the projections 17*e* are provided in the vicinity of the outlet port 53 and the inlet port 52 of the tube 50 as shown in FIG. 5.

After the tube 50 and the reservoir 14 are attached to the first tube guide frame 17, the connection surfaces of the first tube guide frame 17 and the second tube guide frame 18 are brought into close contact with each other and fixed by the fixing screws 92.

The area between the tube 50 in the vicinity of the outlet port 53 and the tube guide groove 17*c* is closed by packing, adhesive or the like with the first tube guide frame 17 and the second tube guide frame 18 fixed. By this method, the interior of the tube unit 11 becomes a closed structure.

The packing 97 engages with the outer circumference of the tube unit 11 in the vicinity of the fixing frame 13 to provide the inside closed space with the tube unit 11 inserted into the control unit 12 as water-proof structure and dust-proof structure of the micropump 10.

The packing 97 can be eliminated when waterproof is not required for the micropump 10.

A tube regulating wall 17*d* as a concave extending along the tube guide groove 17*c* is provided at least on the flat surface area of the tube guide groove 17*c* where the fingers 40 through 46 press the tube 50 in the direction in which the fingers 40 through 46 shift.

An elastic member 60 is provided inside the concave. That is, the elastic member 60 is provided between the tube regulating wall 17*d* and the tube 50. The elastic member 60 is provided as a damper for the pressure produced when the tube 50 is closed by the fingers 40 through 46 so as to prevent deterioration of the tube 50. The elastic member 60 has sufficient elasticity for closing the tube 50. It is preferable that the coefficient of friction with the tube 50 is set at a low value.

An air-bent filter 65 is provided at the junction between the tube 50 and the reservoir 14 as a component through which the tube 50 and the reservoir 14 can communicate. The air-bent filter 65 contains lyophilic filter having small holes. This filter transmits liquid and blocks passage of bubbles.

The holes formed in the filter are in the range from 0.1 μm to 1 μm to allow passage of liquid and prevents entrance of bubbles of 0.1 μm or larger or 1 μm or larger generated in the reservoir 14 into the tube 50.

A projection 17*b* is provided at the base of the first tube guide frame 17, and a projection 17*n* is provided on the outer surface of the end. Similarly, projections 18*a* and 18*b* are provided at the base and the outer surface of the end of the second tube guide frame 18.

The pair of the projections 17*b* and 18*a*, and the pair of the projections 17*n* and 18*b* become continuous ring-shaped projections when the first tube guide frame 17 and the second tube guide frame 18 are coupled to each other.

The accuracy in positioning the control unit 12 and the tube unit 11 for slidingly inserting the tube unit 11 into the control unit 12 can increase by providing the projections 17*b*, 17*n*, 18*a*, and 18*b*. Also, resistance produced when inserting or removing the tube unit 11 can decrease.

A projection 96 having a groove 96*a* is formed on the back of the tube unit 11 (fixing frame 13 side). The projection 96 is used when the tube unit 11 is removed from the control unit 12.

Operation associated with transportation of liquid according to this embodiment is now described with reference to FIG. 5. The cam 20 is rotated by the rotation force of the step motor 70 (direction of arrow R in the figure), and the finger 44 is pressed by the finger pressing surface 21*d* of the cam 20 to close the tube 50 with pressure.

The finger 45 also contacts the junction between the finger pressing surface 21*d* and the finger pressing slope 22 to close the tube 50. The degree of press by the finger 46 on the finger pressing slope 22 against the tube 50 is smaller than that of press by the finger 44. Thus, the finger 46 does not completely close the tube 50.

The fingers 41 through 43 are disposed within the range of the circular-arc portion 23 of the cam 20 at the initial positions providing no pressing. The finger 40 contacts the finger pressing slope 22 of the cam 20, but still does not close the tube 50 at this position.

When the cam 20 is further rotated in the direction of the arrow R from this position, the fingers 45 and 46 press and close the tube 50 in this order by using the finger pressing surface 21*d* of the cam 20. The finger 44 is released from the finger pressing surface 21*d* to open the tube 50. Liquid flows into a liquid flow portion 51 of the tube 50 at the position released from the close by the fingers and the position not yet closed.

When the cam 20 is further rotated by the step motor 70, the finger pressing slope 22 sequentially presses the fingers 40, 41, 42, and 43 from the liquid flow-in side to the liquid flow-out side. When the finger pressing surface 21*c* comes to the fingers, the tube 50 is closed.

By repeating this operation, liquid flows from the inlet port 52 side to the outlet port 53 side, and is discharged through the outlet port 53.

During operation, two of the fingers 40 through 46 contact the finger pressing surface of the cam 20. When shifting to the position for pressing the next finger, one of the fingers is pressed. By repeating the state for pressing two fingers and the state for pressing one finger, such a condition in which at least one finger constantly closes the tube 50 can be produced. This micropump structure produced by movement of the fingers 40 through 46 is called wriggling system.

According to the first embodiment, the tube unit 11 is attached to the control unit 12 in the direction substantially horizontal to the rotation surface of the cam 20. Thus, the thickness of the micropump 10 in this embodiment can be made smaller than that of a related-art structure which stacks the components.

Moreover, a connection mechanism between the tube unit 11 and the control unit 12 required in the related art is not needed. Thus, the structure can be simplified, and assembly can be facilitated.

It is considered that delivery accuracy lowers due to deterioration of restoration of the tube after the tube is kept closed with pressure for a long period. In the structure which separates the tube 50 included in the tube unit 11 from the fingers 40 through 46 included in the control unit 12 for closing the tube 50, the tube 50 within the tube unit 11 is kept opened. Thus, lowering of the delivery accuracy caused by deterioration of restoration by continuous closing of the tube unit 50 is prevented, and desired delivery accuracy can be maintained.

It is also considered that restoration of the tube lowers by repeating close and open conditions of the tube for a long period. In this case, the tube needs to be replaced. In this embodiment, however, the tube 50 can be easily replaced as the tube unit 11, and lowering of delivery accuracy caused by deterioration of restoration after repetitive close and open conditions of the tube for a long period can be prevented.

The tube unit 11 is constituted by the tube 50 and the tube guide frames (first tube guide frame 17 and second tube guide frame 18). Thus, the cost of the tube unit 11 is considerably lower than that of the control unit 12 including the fingers 40 through 46, the cam 20, the step motor 70, the transmission mechanism, and the control circuit unit 30. Accordingly, the running cost can be reduced by making the tube unit 11 which includes the tube 50 directly contacting liquid medicine disposable and using the control unit 12 repeatedly.

Since the tube unit 11 is attached to the inside of the space 110 formed by the first device frame 15 and the second device frame 16 of the control unit 12, the first device frame 15 and the second device frame 16 function as the outer case. Thus, a case for accommodating the tube unit 11 and the control unit 12 is not required, contributing to simplification of the structure and reduction of the thickness of the micropump 10.

According to this structure, the number of connections on the external shape portion of the micropump 10 other than the fixing frame 13 is small. Thus, the closeness (waterproofness) of the interiors of the tube unit 11 and the control unit 12 increases.

According to this embodiment, one or all of the first device frame 15, the second device frame 16, the first tube guide frame 17, and the second tube guide frame 18, or a part or all area of the first device frame 15, the second device frame 16, the first tube guide frame 17, and the second tube guide frame 18 are made of transparent material.

In this structure, the inside components or the engagements and driving conditions of the components can be visually checked through the transparent material to judge whether the normal condition has been achieved or detect where problems are produced. The range of transparency extends at least to the part desired to be visually checked.

In such a structure allowing the reservoir 14 to be visually checked from above or from below, the amount of liquid contained in the reservoir 14 can be observed. It is more preferable that the reservoir 14 is constituted by transparent container.

The tube guide side walls 17*f* and the projections 17*e* provided between adjoining pairs of the fingers 40 through 46 can regulate the position of the tube 50 in the horizontal direction and prevent rising of the tube 50.

The micropump 10 in this embodiment presses the fingers 40 through 46 by rotation of the cam 20 to close the tube 50. Thus, approximate agreement between the center of the circular-arc shape of the tube 50 and the rotation center P of the cam is required.

Thus, the concentric wall surfaces 17*a* and 15*a* with respect to the rotation center P contact each other when the tube unit 11 is attached to the control unit 12. More specifically, by aligning the center of the circular-arc portion of the tube 50 with the rotation center P, all the fingers 40 through 46 can securely close the tube 50.

The tube regulating wall 17*d* for regulating shift of the tube 50 pressed by the fingers 40 through 46 is provided on the tube guide groove 17*c* of the first tube guide frame 17. The plate-shaped elastic member 60 is disposed between the tube 50 and the tube regulating wall 17*d*.

During press of the fingers 40 through 46 against the tube 50, excessive pressing force is absorbed by the elastic member 60. By this method, durability of the tube 50 becomes higher than that of a structure which directly presses the tube 50 against the tube regulating wall. It is more effective to use the elastic member 60 made of material having a small coefficient of friction.

According to this embodiment, the reservoir 14 is accommodated in the tube unit 11. When the tube unit 11 including the tube 50 is replaced at the time of the end of liquid contained in the reservoir 14, the tube 50 can be replaced as the tube unit 11 before deterioration of the tube 50 which may be caused by repetitive close and open conditions for a long period. As a result, reliability of the micropump 10 improves.

The reservoir 14 may be disposed on the outside of the micropump main body and connected with the tube 50. In this case, the capacity of the reservoir 14 can be enlarged.

The reservoir 14 is detachably attached to the tube 50. It is expected that liquid medicine contained in the reservoir 14 runs short during use of the micropump 10. In this case, the micropump 10 can be used for a long time by connecting the reservoir 14 containing liquid medicine to the tube 50 after detaching the reservoir 14 from the tube 50 for replenishment.

The air-bent filter 65 functioning as communicating component as well is provided at the communicating portion between the reservoir 14 and the tube 50.

There is a possibility that air is dissolved in fluid contained in the reservoir. In this case, it is expected that the dissolved air gathers with elapse of time and becomes bubbles. When fluid is liquid medicine and is injected into a living body, the liquid medicine containing bubbles may cause problems which cannot be overlooked.

According to this embodiment, however, the air-bent filter 65 which transmits liquid and blocks passage of bubbles is provided. Thus, injection of bubbles into the living body can be prevented, and safety can be enhanced.

The reservoir 14 has the septum 95 as a port for introducing and sealing liquid. By the function of the septum 95, additional liquid can be easily injected to the reservoir 14 connected with the tube 50.

The septum 95 is held by the opening formed on the first tube guide frame 17 with close contact in such a manner that the inlet portion of the septum 95 sticks out from the outside of the first tube guide frame 17.

In this structure, additional liquid can be easily injected into the reservoir 14 contained in the tube unit 11. Moreover, additional liquid can be injected even while the tube unit 11 is attached to the control unit 12. Furthermore, additional liquid can be easily injected even while the micropump 10 is operating.

Since the septum 95 is closely fixed to the insertion hole of the first tube guide frame 17, entrance of liquid through the septum portion can be prevented.

Second Embodiment

A micropump according to a second embodiment is hereinafter described with reference to the drawings. In the second embodiment, a plurality of fingers have a separation preventing mechanism for preventing separation of the fingers from the control unit 12. In the following explanation, the difference from the first embodiment is chiefly touched upon. Since the fingers 40 through 46 have the same shape, only the finger 43 is discussed as an example.

FIGS. 8A and 8B are cross-sectional views illustrating a part of the micropump in the second embodiment. FIG. 8A shows a first example, and FIG. 8B shows a second example.

The first example is now described with reference to FIG. 8A. The first device frame 15 has a finger guide hole 85 into which the finger 43 is inserted. The finger guide hole 85 is formed by sealing the upper opening of the groove 15*h* of the first device frame 15 by the second device frame 16 similarly to the structure shown in FIG. 6B.

The finger 43 has the shaft 43*a* to be inserted into the finger guide hole 85, the fringe-shaped tube pressing portion 43*c* larger than the finger guide hole 85, and the cam contact portion 43*b* having a smooth round end to contact the cam 20.

The opening formed on the finger guide hole 85 on the cam 20 side has a fringe 15*j* projecting from both the first device frame 15 and the second device frame 16 toward the inside of the finger guide hole 85. The shaft 43*a* of the finger 43 has a stopper groove 43*d* having a smaller diameter than that of the fringe 15*j* in the circumferential direction.

The position of the finger 43 in the axial direction is regulated by attaching the second device frame 16 to the first device frame 15 after the fringe 15*j* is inserted into the groove 15*h* constituting the finger guide hole 85 within the range of the stopper groove 43*d*. The stopper groove 43*d* has such a size that the finger 43 can advance and retreat from the position for closing the tube 50 by the cam 20 (indicated by finger 43' in the figure) to the opening position.

The finger guide holes 85 are through holes allowing the fingers 40 through 46 to freely advance and retreat. Thus, before the tube unit 11 is attached, there is a possibility that the fingers 40 through 46 separate from the finger guide holes 85. Separation of the fingers can be prevented by using the separation preventing mechanism described above.

The fringe 15*j* may be provided on either the first device frame 15 or the second device frame 16 to provide the advantages in this embodiment.

The second example is now discussed. The second example is different from the first example in that a stopper fringe 43*e* for regulating the positions of the fingers for advance and retreat is provided. In the following explanation, the difference from the first example is chiefly touched upon. Since the fingers 40 through 46 have the same shape, only the finger 43 is discussed as an example.

As illustrated in FIG. 8B, the first device frame 15 has the finger guide hole 85 into which the finger 43 is inserted. The finger 43 has the shaft 43*a* to be inserted into the finger guide hole 85, the fringe-shaped tube pressing portion 43*c* larger than the finger guide hole 85, and the cam contact portion 43*b* having a smooth round end to contact the cam 20.

The shaft 43*a* has the stopper fringe 43*e* projecting in the space of the first device frame 15 on the cam 20 side and larger than the finger guide hole 85. The position of the finger 43 in the axial direction is regulated by attaching the second device frame 16 to the first device frame 15 after attaching the groove 15*h* constituting the finger guide hole 85 to the area between the tube pressing portion 43*c* and the stopper fringe 43*e*. The stopper fringe 43*e* has a size determined so as to advance and retreat from the position for closing the tube 50 by the cam 20 (indicated by finger 43' in the figure) to the opening position.

The finger 43 has such a size as to advance and retreat from the position for closing the tube 50 by the cam 20 (indicated by stopper fringe 43*e*') to the opening position between the tube pressing portion 43*c* and the stopper fringe 43*e*.

According to this structure, shift of the finger 43 in the axial direction is regulated between the tube pressing portion 43*c* and the stopper fringe 43*e* to prevent separation of the fingers from the finger guide holes 85.

It is possible to provide a concave portion for accommodating the stopper fringe 43*e* at an intermediate position (middle position) of the finger guide hole 85 in the axial direction.

Third Embodiment

A micropump according to a third embodiment is now discussed with reference to the drawings. In the third embodiment, the first tube guide frame 17 has a tube guide groove 17*c* into which the tube 50 is inserted, and a tube supporting member for supporting the tube 50. In the following explanation, the difference from the first embodiment is chiefly touched upon.

FIGS. 9A through 9C illustrate the micropump in the third embodiment. FIG. 9A is a plan view illustrating a part of the micropump, FIG. 9B is a cross-sectional view taken along a line B-B in FIG. 9A, and FIG. 9C is a cross-sectional view taken along a line D-D in FIG. 9A. A first example is initially discussed.

As illustrated in FIGS. 9A and 9B, the first tube guide frame 17 has the tube guide groove 17*c* into which the tube 50 is inserted. It is difficult to form a continuous side wall on the tube guide groove 17*c* along the tube 50 in the direction of the fingers 40 through 46 for advance and retreat movements of the fingers 40 through 46.

Thus, a tube supporting plate 98 as a tube supporting member corresponding to this side wall is provided. The tube supporting plate 98 is formed by thin metal plate and provided along the tube 50. The tube supporting plate 98 is fixed to a tube supporting plate fixing surface 17*j* formed along a curved wall surface 17*a* of the first tube guide frame 17.

As illustrated in FIG. 9B, the tube supporting plate 98 has an opening 98*a* into which the fingers 40 through 46 are inserted. The opening 98*a* may be one hole into which all the fingers 40 through 46 are inserted or seven through holes into which the fingers 40 through 46 are separately inserted.

The tube supporting plate 98 is fixed to the first tube guide frame 17 at a position away from the fingers 40 through 46. The fixing structure is shown in FIG. 9C as an example. According to this example, two guide shafts 17*q* projecting from the first tube guide frame 17 are inserted into holes formed on the tube supporting plate 98, and then the ends of the guide shafts 17*q* are crushed. Alternatively, the tube supporting plate 98 may be bonded to the tube supporting plate fixing surface 17*j*.

According to this structure, the position of the tube 50 on the fingers side can be regulated by the tube supporting plate 98. When the tube supporting plate 98 is made of metal, the thickness of the metal plate can be extremely reduced. Thus, the tube supporting plate 98 can be disposed in a narrow space leaving sufficient rigidity.

When the opening 98*a* is provided on the tube supporting plate 98 for each finger, a part of the tube supporting plate 98 remains between the respective openings. Thus, the tube supporting portions can be formed between the respective fingers.

According to the structure using the tube supporting plate 98, rising of the tube 50 can be prevented by disposing the projections 17*h* (see FIG. 5) at positions close to the outlet port 53 and the inlet port 52 of the tube 50.

A second example of the third embodiment is now discussed. In the second example, the tube supporting plate 98 of the first example is constituted by an extendable sheet. Though not shown in the figure, the second example is explained with reference to FIGS. 9A through 9C.

The tube supporting plate according to the second example is constituted by an extendable silicon wrap, and does not have openings into which the fingers 40 through 46 are inserted. The silicon wrap is affixed to the tube supporting plate fixing surface 17*j* formed on the first tube guide frame 17.

The silicon wrap extends when the tube 50 is pressed by the fingers 40 through 46 without imposing load for preventing shift of the fingers 40 through 46, and follows the movement of the fingers 40 through 46. Thus, a continuous tube guide portion can be formed on the fingers side.

Fourth Embodiment

A fourth embodiment is now discussed with reference to the drawings. In the fourth embodiment, an elastic member for urging the tube unit 11 toward the control unit 12 is provided. In the following explanation, the difference from the first embodiment is chiefly touched upon.

FIGS. 10A and 10B illustrate a micropump according to the fourth embodiment. FIG. 10A is a partial plan view, and FIG. 10B is a cross-sectional view cut along a line E-E in FIG. 10A. As illustrated in FIG. 10A, a plate spring 99 as the elastic member is provided between the tube unit 11 and the fixing frame 13.

The plate spring 99 is fixed to a concaved plate spring fixing portion 13*f* formed on the fixing frame 13 on the tube unit 11 side. The point of force of the plate spring 99 lies on a center line F to urge the tube unit 11 toward the rotation center P of the cam 20.

By this method, the wall surface 17*a* of the tube unit 11 and the wall surface 15*a* of the control unit 12 contact each other on the center line F.

As illustrated in FIG. 10B, the plate spring 99 is fixed by fixing a guide shaft 13*g* projecting from the plate spring fixing portion 13*f* of the fixing frame 13 using fixing method such as thermal deposition. The plate spring 99 is not required to be fixed as long as the plate spring 99 is not separated from the fixing frame 13 in the fixed condition without losing elasticity of the plate spring 99.

When the tube unit 11 is fixed to the control unit 12 by the fixing frame 13, there is a possibility that the tube 50 cannot be closed by the fingers 40 through 46 by presence of a space in the horizontal direction between the tube unit 11 and the control unit 12 caused by size variations of the components of the tube unit 11, the control unit 12, and the fixing frame 13.

In this embodiment, the wall surfaces 15*a* and 17*a* are brought into contact with each other by urging the tube unit 11 toward the control unit 12 using the plate spring 99. In this case, the center of the circular-arc shape of the tube 50 and the rotation center of the cam 20 almost agree with each other, and thus the fingers 40 through 46 can securely close the tube 50.

The elastic force of the plate spring 99 is so designed as to be larger than the tube pressing force of the fingers 40 through 46.

By this method, the tube unit 11 (i.e., tube 50) does not shift in the direction away from the fingers 40 through 46 when the fingers 40 through 46 close the tube 50. Thus, the tube 50 can be securely closed.

While the plate spring 99 is shown as an example of the elastic member, the elastic member may be coil spring or flat plate having elasticity in the thickness direction, or a structure having plural springs of these types.

Fifth Embodiment

A micropump according to a fifth embodiment is now described with reference to the drawings. In the fifth embodiment, the power source is accommodated in the tube unit. In the following explanation, the difference from the first embodiment is chiefly touched upon.

FIGS. 11A and 11B illustrate the micropump according to the fifth embodiment. FIG. 11A is a partial plan view, and FIG. 11B is a cross-sectional view cut along a line G-G in FIG. 11A. As illustrated in FIGS. 11A and 11B, a miniature button-type battery 120 (hereinafter abbreviated as battery 120) as a power source is accommodated within the tube unit 11.

The battery 120 is attached to a concave formed on the first tube guide frame 17 with the reservoir 14 with the upper portion of the battery 120 sealed by the second tube guide frame 18. Assuming that the lower surface of the battery 120 in the figure is the negative pole and that the upper and the side surfaces are the positive pole, the lower surface and the side surface are connected with a negative terminal 121 and a positive terminal 122, respectively.

The negative terminal 121 and the positive terminal 122 are connected with connection terminals 123 and 124 inserted into the end of the first tube guide frame 17 by not-shown leads.

The connection terminals 123 and 124 project from the first tube guide frame 17 and extend to the inside of the control unit 12. The control unit 12 has connection terminals (not shown) connected with the connection terminals 123 and 124 separately in electricity, and the connection terminals of the control unit 12 are connected with the control circuit unit 30 (see FIG. 5).

Power is supplied from the battery 120 to the control circuit unit 30 after the tune unit 11 is attached to the control unit 12. As a result, a condition in which the micropump 10 can operate is produced.

It is possible to accommodate the battery 120 within the tube unit 11 and dispose the reservoir 14 on the outside of the tube unit 11.

In case of replacement of the tube 50 after long-term use for changing liquid medicine to be used, the capacity of the battery does not run short in the middle of use by replacing the battery 120 together with the tube 50 as the tube unit 11.

The battery 120 is detachably attached to the tube unit 11. According to the structure shown in FIGS. 11A and 11B, the battery 120 is attached and detached by removing the fixing screws 92 connecting the first tube guide frame 17 and the second tube guide frame 18 (see FIG. 5), for example.

In this case, the attaching and detaching structure of the battery 120 may be a structure having a battery cover on the second tube guide frame 18, or may be a structure for slidingly inserting the battery 120 from the back of the tube unit 11 (fixing frame 13 side) to attach and detach the battery 120 after removing the fixing frame 13.

While the miniature button type battery has been used as the power source in this embodiment, the power source may be a secondary battery such as a sheet battery and a lithium ion battery. These types of battery can be stacked on the reservoir, or the capacity of the reservoir can be increased by disposing the battery within the tube unit.

Sixth Embodiment

A micropump according to a sixth embodiment is now described with reference to the drawings. In the sixth embodiment, a detection unit including a connection terminal and a detection terminal for detecting whether the tube unit is inserted to an accurate position of the control unit. In the following explanation, the difference from the first embodiment is chiefly touched upon.

FIGS. 12A and 12B illustrate the micropump in the sixth embodiment. FIG. 12A is a partial plan view, and FIG. 12B is a cross-sectional view cut along a line H-H in FIG. 12A. As illustrated in FIGS. 12A and 12B, a first connection terminal 66 and a second connection terminal 67 are inserted into both peninsula-shaped ends of the circular-arc shaped wall surface 17*a* of the tube unit 11 (first tube guide frame 17).

One ends of the first connection terminal 66 and the second connection terminal 67 are electrically connected with each other by a connection lead 94. The other ends project from tube unit side ends 17*k* and 17*m* in such a manner as to enter into the control unit 12.

The control unit 12 (first device frame 15) has a first detection terminal 68 and a second detection terminal 69 having substantially U-spring shapes. Since the first detection terminal 68 and the second detection terminal 69 have the same shape, only the second detection terminal 69 is explained as an example.

The second detection terminal 69 is bended and inserted into a concave formed on the first device frame 15. Arms 69*a* and 69*b* of the second detection terminal 69 press the opposed side wall within the concave.

Thus, the position of the arm 69*a* is regulated by a side wall 15*g* within the concave. The position of the side wall 15*g* is accurately regulated with respect to the rotation center P of the cam 20. The end positions of the first connection terminal 66 and the second connection terminal 67 are also accurately regulated with respect to the rotation center P of the cam 20.

When the tube unit 11 is attached to the control unit 12 until the circular-arc-shaped wall surface 17*a* of the tube unit 11 and the circular-arc-shaped wall surface 15*a* of the control unit 12 contact each other, the second terminal 67 is electrically connected with the second detection terminal 69. Simultaneously, the first connection terminal 66 is electrically connected with the first detection terminal 68.

A lead 64 is connected with the second detection terminal 69, and further connected with a detection terminal A (not shown) of the control circuit unit 30. A lead 63 is connected with the first detection terminal 68, and further connected with a detection terminal B (not shown) of the control circuit unit 30.

When the detection terminals A and B detect that both the pair of the second connection terminal 67 and the second detection terminal 69 and the pair of the first connection terminal 66 and the first detection terminal 68 have been electrically connected, it is judged that the circular-arc-shaped wall surface 17*a* of the tube unit 11 and the circular-arc-shaped wall surface 15*a* of the control unit 12 contact each other.

In this condition, it is determined that the center of the circular-arc shape of the tube 50 coincides with the rotation center P of the cam 20, and a condition in which the step motor 70 (not shown) can be operated by the control circuit unit 30 is produced.

When both the pair of the second connection terminal 67 and the second detection terminal 69 and the pair of the first connection terminal 66 and the first detection terminal 68 are not electrically connected, it is determined that operation cannot be performed. Thus, attachment of the tube unit 11 to the control unit 12 is again carried out.

While contact point system has been used as the detection unit in this embodiment, the detection unit may be provided by light detection or magnetic detection structure.

In this case, tube 50 can be closed or opened in accordance with the setting by actuation of the step motor 70 when it is detected that the center of the circular-arc shape of the tube 50 almost agrees with the rotation center P of the cam 20. Thus, liquid can be transported with a desired flow amount per unit time.

According to the first through sixth embodiments, the micropump 10 can be made compact and thin, and can constantly supply a small amount of fluid in a stable condition. Thus, the micropump 10 can be appropriately attached to the inside or the surface of a living body as medical supplies associated with development of new medicine or drug delivery. Also, the micropump 10 can be mounted within various machines or outside various machines to transport fluid such as water, salt water, liquid medicine, oil, aromatic liquid, ink, and gas. Furthermore, the micropump 10 can be used as an independent unit for delivering and supplying fluid.

The entire disclosure of Japanese Patent Application No. 2008-211483, filed Aug. 20, 2008 is expressly incorporated by reference herein.

What is claimed is:

1. A micropump comprising:

a tube unit which includes a tube having elasticity and a circular-arc-shaped part and a tube guide frame for holding the tube, the circular-arc-shaped part being disposed between a pair of lobes of the tube guide frame when viewed in plan;

a control unit which has a plurality of fingers extending from the center of the circular-arc shape of the tube in radial directions, a cam for sequentially pressing the plural fingers from an inlet side to an outlet side of the tube, a drive unit for giving rotation force to the cam, a control circuit unit for controlling operation of the drive unit, and a device frame for holding the plural fingers, the cam, the drive unit, and the control circuit unit, the device frame including sidewalls that define a pair of recesses that correspond to the pair of lobes of the tube guide frame;

a reservoir communicating with an inlet port of the tube; and a power source for supplying power to the control circuit unit, wherein the tube unit is detachably coupled to the control unit substantially in the horizontal direction with respect to the rotation surface of the cam and attached to the inside of a space produced by the device frame such that the lobes of the tube guide frame mate with and abut the sidewalls of the device frame that define the recesses.

2. The micropump according to claim 1, wherein the tube guide frame has a tube guide groove into which the tube is inserted, and a tube supporting portion for supporting the tube inside the tube guide groove.

3. The micropump according to claim 1, wherein a guide portion, which disposes the center of the circular-arc shape of the tube and the rotation center of the cam substantially at the same position when the tube unit is attached to the control unit, is provided on the tube unit and the control unit.

4. The micropump according to claim 3, wherein a detection unit, which detects that the center of the circular-arc shape of the tube and the rotation center of the cam have been disposed substantially at the same position when the tube unit is attached to the control unit, is provided between the tube unit and the control unit.

5. The micropump according to claim 1, wherein:

the device frame has finger guide holes to which each of the plurality of fingers are attached;

each of the plurality of fingers has a shaft to be attached to the corresponding finger guide hole, and a fringe-shaped tube pressing portion larger than the finger guide hole; and the plurality of fingers have a separation preventing mechanism which prevents separation of the fingers from the finger guide holes in an axial direction.

6. The micropump according to claim 5, wherein:

the separation preventing mechanism has projections;

each of the plurality of fingers has a groove in the circumferential direction of the shaft; and the projections are attached to the grooves to regulate shift of the plurality of fingers in the axial direction.

7. The micropump according to claim 5, wherein:

each of the plurality of fingers has a stopper fringe disposed on the shaft at an end opposite to the tube pressing portion or at an intermediate position; and shift of the plurality of fingers in the axial direction is regulated by the tube pressing portions and the stopper fringes, or concaves formed at intermediate positions of the finger guide holes in the axial direction for accommodating the stopper fringes.

8. The micropump according to claim 1, further comprising:

a tube regulating wall disposed on the tube guide frame and pressed by the plurality of fingers to regulate shift of the tube; and an elastic member disposed between the tube and the tube regulating wall.

9. The micropump according to claim 1, further comprising:

a cover member which fixes the tube unit to the control unit; and an elastic member disposed between the cover member and the tube unit to urge the tube unit toward the control unit.

10. The micropump according to claim 9, wherein the elastic force of the elastic member is larger than the tube pressing force of the plurality of fingers.

11. The micropump according to claim 1, wherein a part or all parts of the device frame and the tube guide frame is transparent.

12. The micropump according to claim 1, wherein the power source is accommodated in the tube unit.

13. The micropump according to claim 12, wherein the power source is detachably attached to the tube unit.

14. The micropump according to claim 1, wherein the reservoir is detachably attached to the tube.

15. The micropump according to claim 1, wherein the reservoir is accommodated in the tube unit.

16. The micropump according to claim 1, wherein the reservoir and the power source are accommodated in the tube unit.

17. The micropump according to claim 1, wherein the reservoir has a port.

18. The micropump according to claim 17, wherein:

the reservoir is accommodated in the tube unit; and the port is supported on an opening formed on the tube guide frame such that an inlet portion of the port can project from the outside of the tube guide frame.

19. The micropump according to claim 1, further comprising an air-bent filter provided on the communicating portion between the reservoir and the tube to block passage of a bubble.

20. The micropump according to claim 1, wherein the power source is accommodated in the control unit.

* * * * *